US005203839A

United States Patent [19]

Skaggs

[11] Patent Number: 5,203,839

[45] Date of Patent: Apr. 20, 1993

[54] APPARATUS FOR DISPENSING ADHESIVE MATERIALS

[76] Inventor: Kenneth R. Skaggs, 27881 Flynn Creek, Barrington, Ill. 60010

[21] Appl. No.: 715,408

[22] Filed: Jun. 14, 1991

[51] Int. Cl.[5] ..... B67D 5/52

[52] U.S. Cl. ..... 222/137; 222/334; 222/389; 184/105.2

[58] Field of Search ..... 222/137, 258, 261, 327, 222/389, 334; 184/29, 38.1, 105.2; 417/390, 544

[56] References Cited

U.S. PATENT DOCUMENTS

| | | | |
|---|---|---|---|
| 1,868,701 | 7/1932 | Goerland | 222/389 |
| 2,563,636 | 8/1951 | Ballard | 222/389 |
| 3,311,265 | 2/1967 | Creighton, Jr. et al. | 222/137 |
| 3,323,682 | 6/1967 | Creighton, Jr. et al. | 222/94 |
| 3,390,814 | 7/1968 | Creighton, Jr. et al. | 222/137 |
| 3,568,885 | 3/1971 | Spencer | 141/258 |
| 3,570,719 | 3/1971 | Schiff | 222/137 |
| 3,768,472 | 10/1973 | Hodosh et al. | 128/218 P |
| 3,964,644 | 6/1976 | Wallace | 222/146 HE |
| 4,113,151 | 9/1978 | Brown et al. | 222/324 |
| 4,201,318 | 5/1980 | Adams | 222/389 |
| 4,376,498 | 3/1983 | Davis, Jr. | 222/326 |
| 4,471,888 | 9/1984 | Herb et al. | 222/137 |
| 4,566,610 | 1/1986 | Herb | 222/137 |
| 4,826,050 | 5/1989 | Murphy et al. | 222/334 |
| 4,869,400 | 10/1989 | Jacobs | 222/137 |
| 4,871,088 | 10/1989 | Cox | 222/47 |
| 4,878,601 | 11/1989 | Flemming et al. | 222/137 |
| 4,907,727 | 3/1990 | Ernst et al. | 222/386.5 |
| 4,911,328 | 3/1990 | Keller | 222/47 |
| 4,913,553 | 4/1990 | Falco | 366/129 |
| 4,934,827 | 6/1991 | Taschke et al. | 366/162 |
| 4,976,372 | 12/1990 | Rogers, Jr. | 222/389 |
| 5,005,735 | 9/1991 | Keller | 222/137 |
| 5,015,233 | 5/1991 | McGough et al. | 222/389 |
| 5,020,693 | 6/1991 | Ernst et al. | 222/137 |
| 5,064,098 | 11/1991 | Hutter, III et al. | 222/389 |

*Primary Examiner*—Andres Kashnikow
*Assistant Examiner*—Philippe Derakshani
*Attorney, Agent, or Firm*—Fitch, Even, Tabin & Flannery

[57] ABSTRACT

Portable apparatus for dispensing adhesive materials from cartridge type containers using axially directed plungers which are driven by a manually operated hydraulic pump supplying pressurized fluid to a hydraulic cylinder. The output of the hydraulic cylinder is coupled to a pair of plungers that engage the cartridges to force the adhesive materials out through a mixing nozzle.

23 Claims, 4 Drawing Sheets

APPARATUS FOR DISPENSING ADHESIVE MATERIALS

BACKGROUND OF THE INVENTION

The present invention relates generally to portable dispensing apparatus and, more specifically, to apparatus for dispensing and mixing the components of an epoxy resin.

It is well known that many types of caulking and adhesives of various types are marketed in tubes or cartridges that require a particular type of gun or tool for use in dispensing the contents of these cartridges. The cartridges typically comprise a cylindrical tubular housing having a dispensing or discharge opening at one end and a displaceable wall at the other end. The gun or tool used with such cartridges provides a plunger that may be inserted into the tube against the displaceable wall which is moved axially to discharge the contents of the cartridge. Because of the sealing engagement required between the movable wall and the tubular housing of the cartridge and the viscous nature of the materials involved, a considerable amount of force is required to move the plunger to displace the end wall of the cartridge and dispense the contents.

The typical gun used by the homeowner to dispense caulking from a cartridge is a purely mechanical device using a type of lever and ratchet mechanism which is low in cost and reasonably adequate for the limited use to be made of it. These commonly used caulking guns have a horizontal cartridge holder with a depending handle. A manually operated lever is pulled toward the handle to operate a ratchet mechanism that ratchets forward a plunger on the free end of the plunger. However, for commercial applications or even extensive domestic applications such guns or tools prove to be unsatisfactory. Particularly in applications involving epoxy where two separate cartridges containing different constituent materials must be dispensed at the same time, the power available in the purely mechanical tools is not adequate. To obtain the force required to dispense from two cartridges at the same time, a greater mechanical advantage is needed if the tool is to be manually operated rather than relying on electrical power or compressed air.

There are many situations in the construction industry in which epoxy adhesives are used where there is no easily available supply of power for such tools. For example in road construction and road repair, there is a need to use epoxy to secure pieces of reinforcing bars together to improve the positioning of the reinforcing bars and strengthen the road after the concrete has been poured around the reinforcing bars. The use of powered tools is often impractical, requiring generators, compressors and the like, but there are currently no acceptable alternatives to the power dispensing tools.

There is a need for a simple-to-operate hydraulic caulking or dispensing gun. Preferably, the hydraulic dispensing gun would have a horizontal holder for one or more dispensing cartridges and a depending handle with a simple lever operation much like the mechanical caulking guns. Such caulking guns are very portable and can be used by workmen in awkward or tight places. The caulking gun should be relatively lightweight and relatively small so that it can be easily manipulated by a workman in a tight space or in an awkward location, to dispense the cartridge material where desired. Preferably the hydraulic caulking gun is simple in design and in operation, without a lot of hoses or parts projecting about that could become damaged or broken with rough usage at a construction site or which could interfere with the manipulation of the gun. Also, it is preferable that the hydraulic gun be relatively simple and straightforward in its manner of usage so that it may be readily employed by unskilled workmen as well as skilled workmen. Preferably, the hydraulic caulking gun should be relatively rugged and robust, thereby needing little maintenance or repair despite being subject to rough usage. The present invention is directed to providing a hydraulic caulking or dispensing apparatus that achieves one or more or all of these objectives.

SUMMARY OF THE INVENTION

The present invention is directed to a hydraulically driven, manually operated adhesive dispensing apparatus. The apparatus provides means for supporting a pair of cartridges of the type containing the constituent materials of an epoxy resin. A frame including the cartridge supporting means serves to mount a pair of plungers for axial movement into dispensing engagement with said cartridges. The apparatus further provides a hydraulic cylinder mounted on the frame beneath the cartridges supporting the ends of the cartridges remote from the frame. The hydraulic cylinder includes a piston and piston rod which extends from the cylinder in parallel spaced relation to the plunger rods. A yoke couples the ends of the hydraulic cylinder rod and the plunger rods so that the hydraulic cylinder may drive the plungers into the cartridges and dispense the contents.

The frame includes a housing enclosing a hydraulic pump connected by suitable conduits to a fluid reservoir and to the hydraulic cylinder. Projecting from the housing is a handle for manipulating the apparatus. A lever mechanism associated with the handle is connected to the pump so that oscillation of the lever reciprocates a pump piston to draw fluid from the reservoir and deliver it under pressure to the hydraulic cylinder. This pumping action drives the hydraulic cylinder piston to the limit of its movement in one direction, causing the plungers to be driven into the cartridges to dispense their contents, which contents are mixed in the common nozzle for both cartridges.

In order to permit return of the plungers and the associated driving mechanism to the initial position in which cartridges may be loaded and unloaded from the apparatus, a valve controlled bypass is provided to permit passage of fluid directly from the hydraulic cylinder to the reservoir. A manually operated valve is opened and the yoke is grasped by the user and moved in a direction opposite from its driven direction, causing the fluid in the hydraulic cylinder to be forced through the bypass back to the reservoir. The manual valve is then closed and the apparatus is in its initial or load position when spent or empty cartridges may be removed and new cartridges loaded.

To reduce the required reservoir size and to minimize the problems of air trapped in the system, the hydraulic fluid is circulated from the reservoir under a reduced pressure to the low pressure side of the hydraulic cylinder piston. The reservoir includes a spring biased wall or piston to apply the reduced pressure to force the hydraulic fluid from the reservoir into the low pressure end of the hydraulic cylinder piston.

The apparatus including the above described features is well suited to portable operation at construction sites where there is no easy access to power for operating power tools. The hydraulic cylinder and pump system is easily operated by hand, providing the operator with a large mechanical advantage to produce adequate force to dispense from two cartridges simultaneously with the application of a relatively low manual force to the pump actuation lever. The movement of the dispensing plungers under the action by the hydraulic mechanism produces a more uniform rate of adhesive dispensing than is obtainable with the normal mechanical dispensers of the prior art. With the prior art dispensers, any variations in the load imposed by the cartridges tends to cause the rate of dispensing to vary in an erratic manner. Because of the greater power available with the hydraulic mechanism, the dispensing rate tends to remain constant regardless of the variations in load that normally occur.

Accordingly it is an object of the present invention to provide improved apparatus for dispensing adhesives from cartridge-type containers.

It is a further object of the present invention to provide improved apparatus for dispensing adhesives from cartridge containers utilizing a manually driven hydraulic mechanism for driving the plungers used with such cartridge containers.

It is another object of the present invention to provide improved portable apparatus for dispensing and mixing epoxy component materials from two separate cartridge-type containers utilizing a manually powered hydraulic mechanisms to drive simultaneously the plungers to discharge the contents of the two cartridge-type containers.

Other objects and advantages of the present invention will be readily apparent from the following description of a preferred embodiment thereof taken in conjunction with the accompanying drawings:

DETAILED DESCRIPTION OF THE PREFERRED EMBODIMENT

Figure 1:
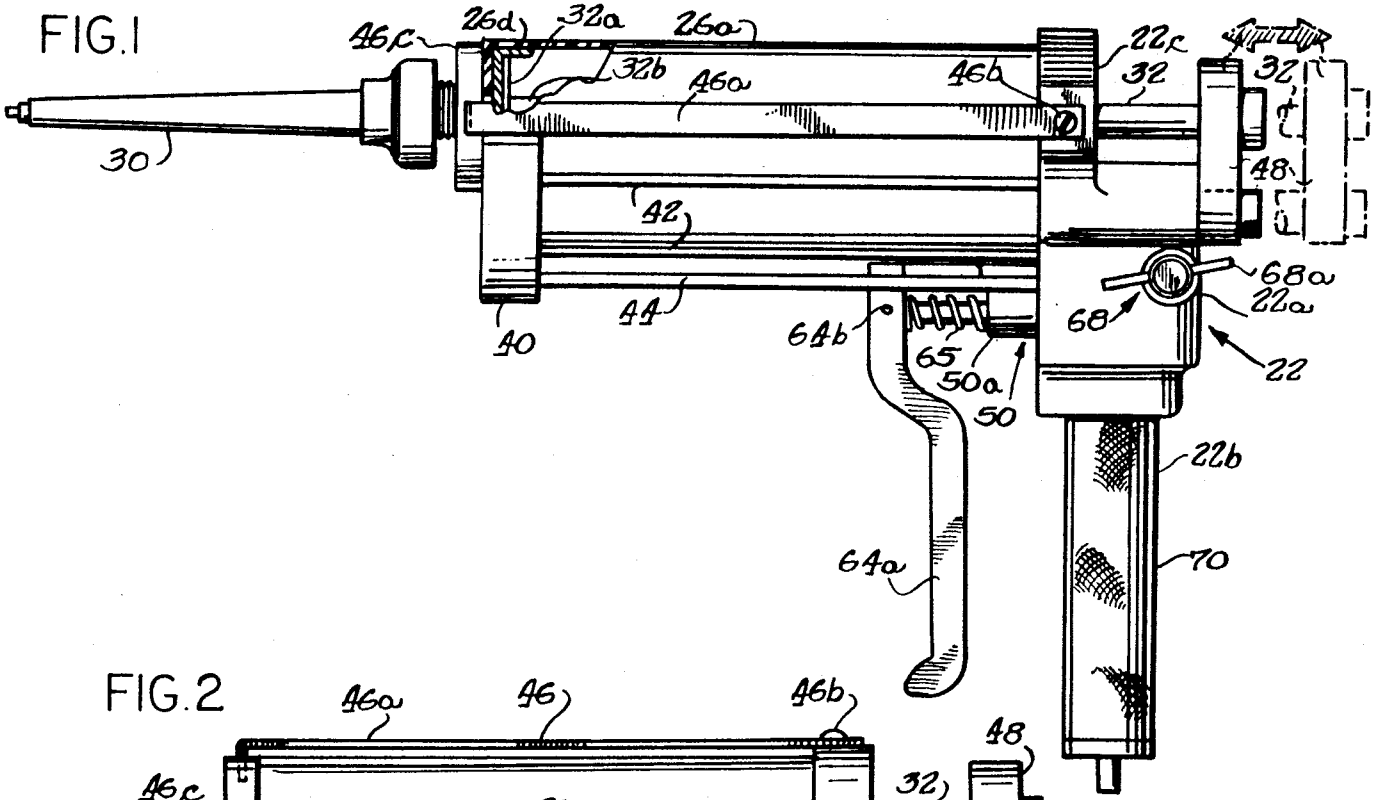
FIG. 1 is a side elevational view of the dispensing apparatus of the present invention with adhesive material cartridges in position for dispensing and with a portion of a cartridge cut away to explore a part of the dispensing plunger.
Figure 2:
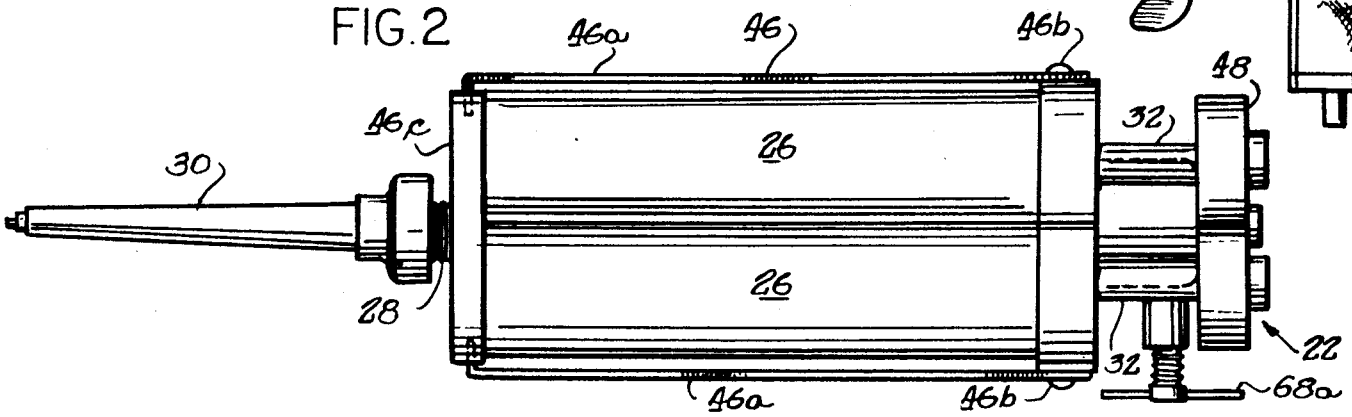
FIG. 2 is a top plan view of the dispensing apparatus of FIG. 1.
Figure 3:
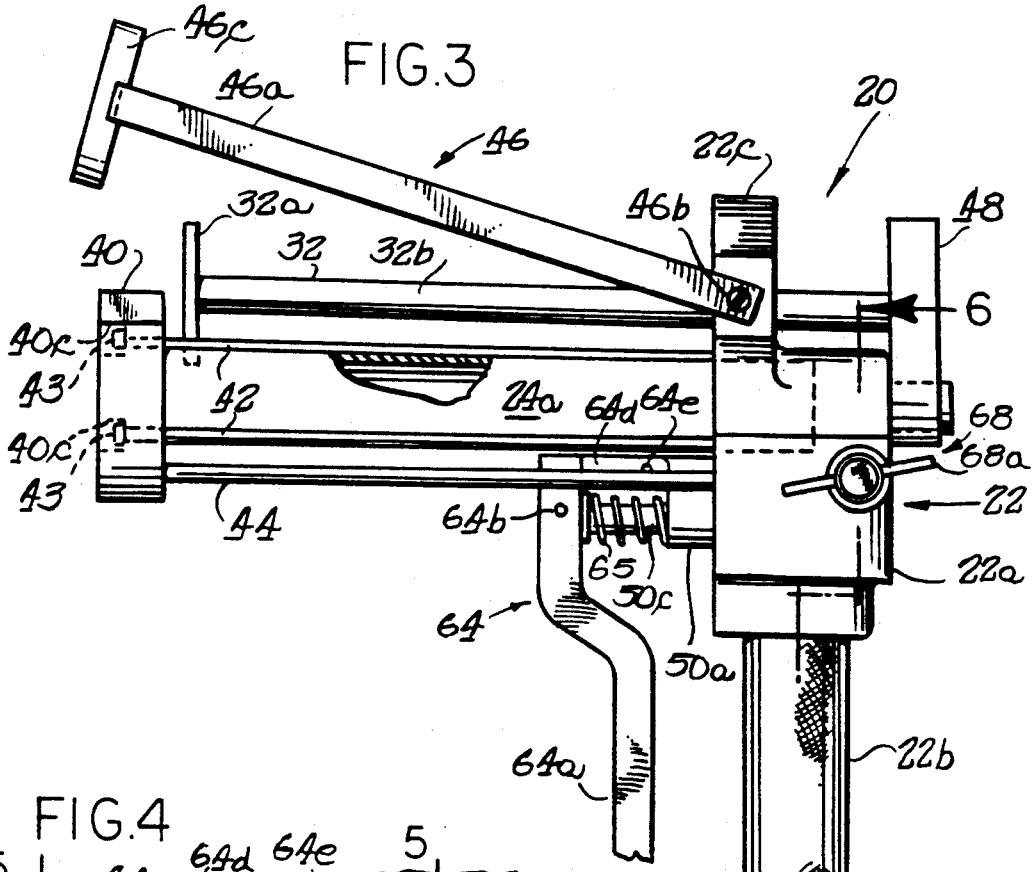
FIG. 3 is a side elevational view of the dispensing apparatus of FIG. 1 with adhesive material cartridges removed and the retaining bail for the cartridges shown in the "load" position.

Referring to the drawings there is shown in FIGS. 1-3 an adhesive dispensing apparatus embodying the present invention and which is designated generally by the reference numeral 20. The apparatus 20 includes a housing 22 having a pump portion **22*a*, a reservoir portion 22*b* and an upper housing portion 22*c*. Supported from the upper housing portion 22*c* is a hydraulic cylinder 24 and a pair of removable adhesive material cartridges 26. The adhesive cartridges 26 are commercially available cartridge containers in which various types of caulking and adhesive materials are sold for dispensing from available apparatus. As is well known, each cartridge includes a cylindrical tubular portion 26*a*, a fixed end wall 26*b* having a restricted opening 26*c* through which the contents of the cartridge 26 are dispensed. At the other end of the cartridge 26 there is provided a movable wall 26*d* which serves as a piston to force the contents of the tube 26*a* out through the opening 26*c*** as the wall is moved inwardly by a suitable plunger.

Figure 9:
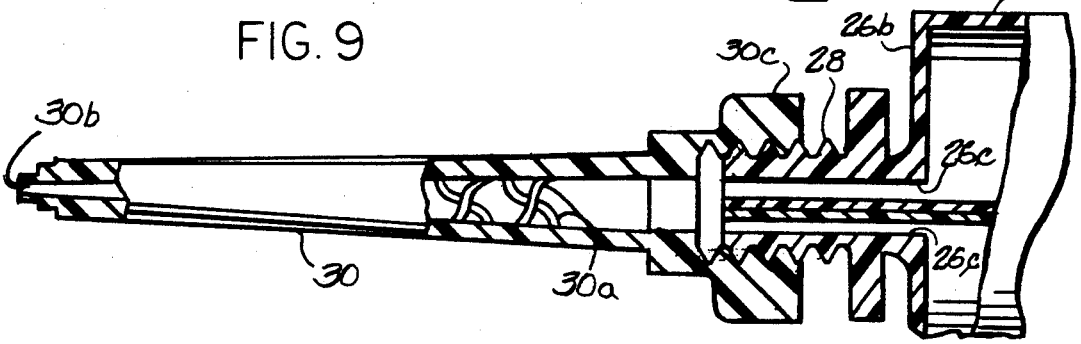
FIG. 9 is a horizontal sectional view of the mixing and dispensing nozzle associated with the adhesive material cartridges for the apparatus of FIG. 1.

In connection with epoxy glues and adhesives which require the mixing of several components to activate them, there are conventionally provided two cartridges which are snapped together and have an outlet 28 formed by two semicylindrical conduits positioned together and extending from the discharge openings **26*c* in each of the cartridges. The outlet 28 then is provided with a combined nozzle 30 which is formed with internal helical vanes 30*a* which tend to swirl and mix together the adhesive materials from the two cartridges 26. The mixed materials are then discharged through the nozzle opening 30*b*. As is best shown in FIG. 9, the nozzle 30 includes an internally threaded portion 30*c* within which the outlet 28** is received.

Figure 7:
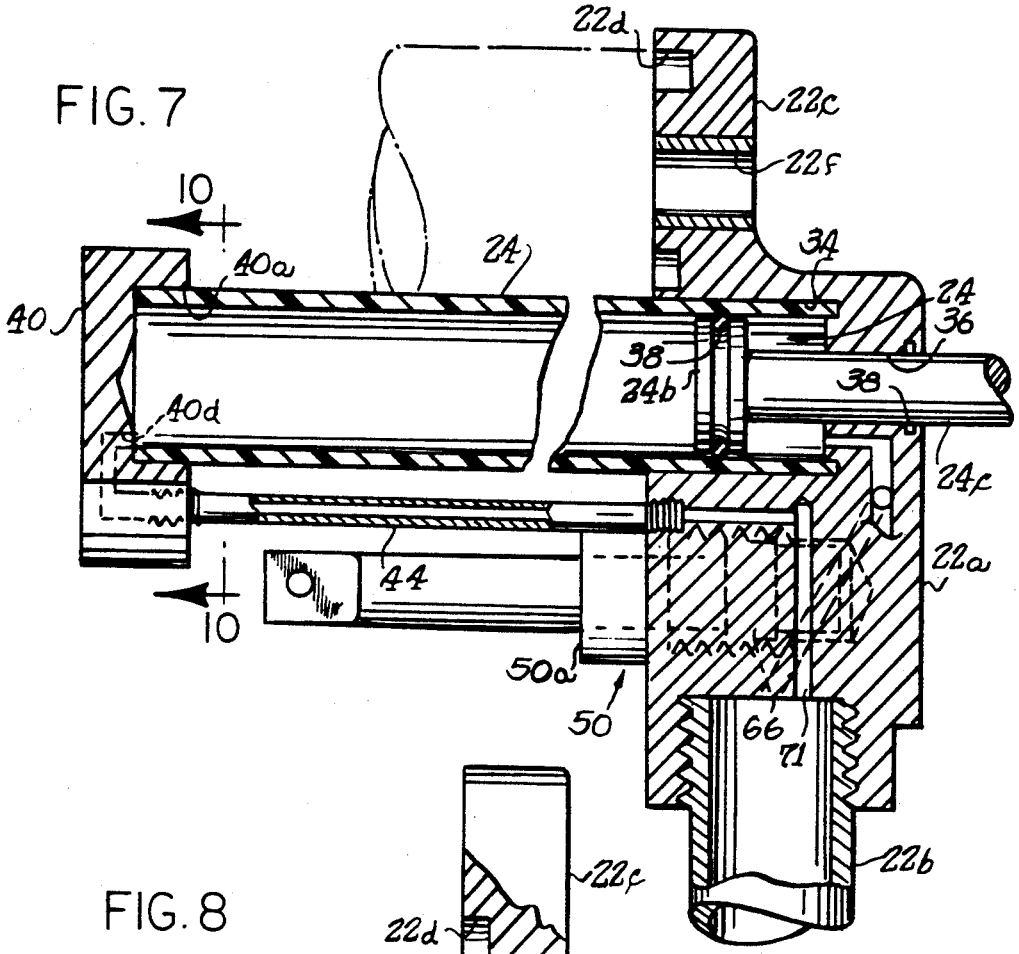
FIG. 7 is a fragmentary vertical sectional view taken substantially on line 7—7 of FIG. 6 assuming FIG. 6 included the complete apparatus.

The hydraulic cylinder 24 serves to force in an axial direction plungers 32 which are mounted for movement into the cartridges 26 to displace the walls **26*d* within the tubes 26*a* to dispense the contents of the cartridges 26. The hydraulic cylinder includes a tubular or cylindrical housing 24*a* within which a power piston 24*b* is mounted for axial movement. The piston 24*b* is coupled to a piston rod 24*c* which extends outwardly of the tubular housing 24*a*. One end of the hydraulic cylinder 24 is received within a recess 34 in the upper housing portion 22*c*, as best shown in FIG. 7. At the bottom of the recess 34, a throughbore 36 is formed which journals the piston rod 24*c*. Sealing rings 38 are provided in the piston 24*b* and the wall of the bore 36 to maintain the sealed enclosure at the right end of the hydraulic cylinder 24**.

Figure 8:
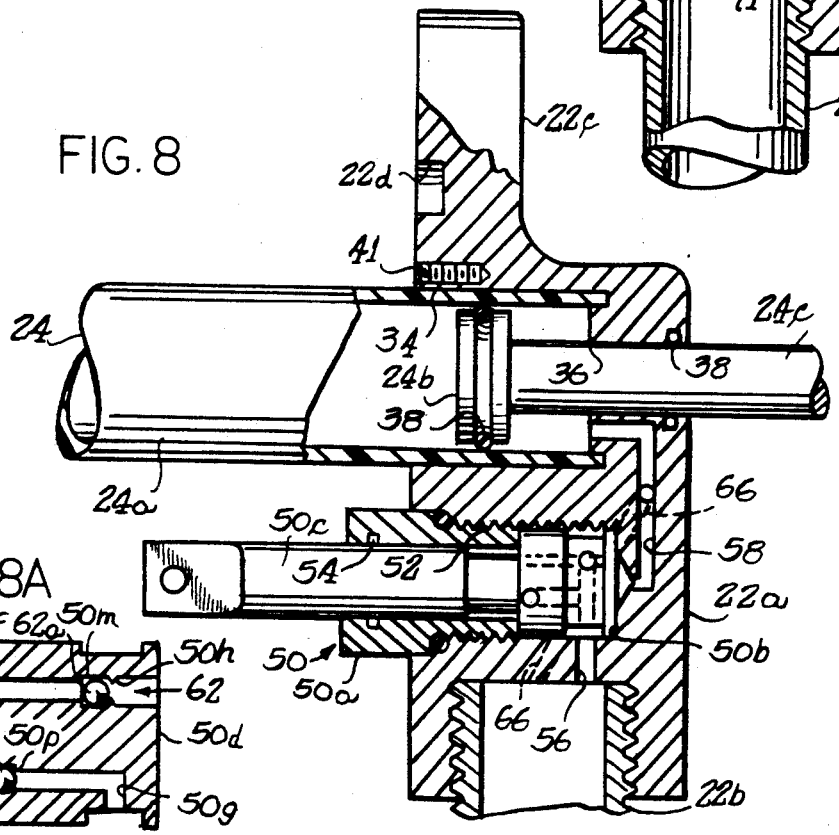
FIG. 8 is an enlarged fragmentary vertical sectional view taken substantially on line 8—8 of FIG. 6 assuming FIG. 6 included the complete apparatus.

The other end of the cylindrical housing **24*a* is closed by an end plate 40 which is secured to the housing 22 by lengthwise extending rods 42 which clamp the tubular housing 24*a* between the housing 22 and the end plate 40. The end plate 40 is formed with a recess 40*a* into which the end of the cylindrical housing 24*a* is received as shown in FIG. 7. Each of the rods 42 is threaded at both ends with one end being threadedly received in an opening 41 in the housing 22 as shown in FIG. 8. There are three rods 42 equally spaced around the hydraulic cylinder 24 as shown in FIG. 8. The end plate 40 is formed with three openings 40b which extend from the side of end plate 40 facing the housing 22 into recesses 40c which are on the opposite side of end plate 40. The recesses 40c are to receive nuts 43 which are threadedly engaged with the ends of rods 42 as shown in FIG. 3. As will be explained in greater detail below, the end plate 40 is formed with a U-shaped passageway 40d which connects to a lengthwise extending conduit 44 extending back to the housing 22 where it connects with a fluid conduit extending into the reservoir portion 22b of the housing 22**.

Figure 10:
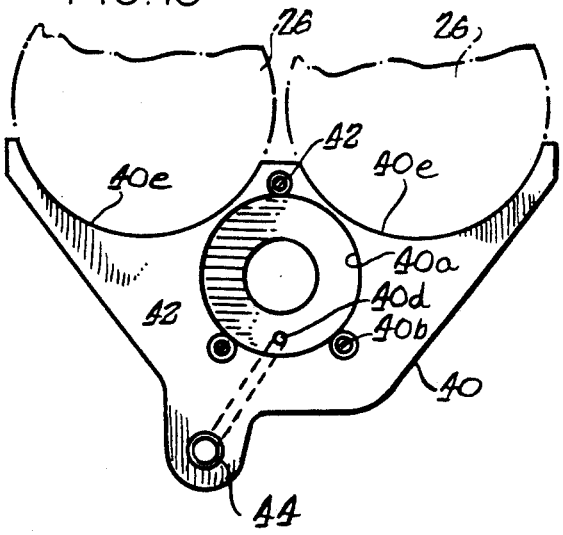
FIG. 10 is a section view taken on line 10—10 of FIG. 7.

The end plate 40 is formed at its upper surface with two curved recesses 40e which receive the dispensing ends of the cartridges 26 as best shown in FIG. 10. In order to retain the cartridges in their assembled position, there is provided a U-shaped bail 46 which includes parallel legs 46a, the outer ends of which are pivotally connected at 46b to the housing 20. At the bight portion of the bail 46 there is provided a retaining plate 46c which is somewhat C-shaped and which swings into position to restrain the cartridges 26 against lengthwise displacement away from the housing 22, and engages the outlet part 28 on the cartridges 26.

The inner ends of the cartridges 26 are received within shallow annular recesses 22d formed in the upper portion 22c of the housing 22. Thus, with the cartridges 26 restrained at one end within the recesses 22d, and at the other end between the end plate 40 on the bottom and the C-shaped bail 46, with its retaining part 46c, the cartridges 26 are held securely in the apparatus 20 during the period in which the contents thereof are dispensed. The plungers 32 referred to above are provided with disc portions 32a which when in the load position of the apparatus 20, are positioned adjacent the recesses 22d, within the tubular portion 26a of the cartridges 26 and are adapted to engage the displaceable walls 26d and to act as drive heads to drive adhesive from the cartridge. The plungers 32 are formed with drive rods 32b which are journalled in bearings 22f, mounted in the upper housing portion 22c. Thus, the bearings 22f journal the plungers 32 for axial movement from the load position with the disc portions adjacent the housing 22 to the final dispensed position as shown in FIG. 3, in which the plungers 32 have displaced the movable walls 26d to the dispense end of the cartridges 26.

In order to couple the piston rod 24c of the hydraulic cylinder 24 to the plungers 32, there is provided a yoke 48 which is secured to the outer ends of the plunger drive rod 32b and the piston rod 24c. Thus, as the hydraulic cylinder 24 drives the piston 24b to the left as shown in FIG. 7, the plungers 32 are driven inwardly with respect to the cartridges 26, thus dispensing the contents through the nozzle 30.

Located within the pump portion 22a of the housing 22 is a hydraulic pump 50 which serves to draw fluid from the reservoir portion 22b and pump it under pressure into the hydraulic cylinder 24. The pump 50 is formed with the body portion 50a which is threadedly received in a recess 52 formed in the housing 22. The body portion 50a, together with the cylindrical recess 52, form a pump chamber 50b. The body portion 50a has an axially extending passageway within which the pump piston 50c is mounted for axial movement. An O-ring seal 54 is provided in the bore for the piston 50c to prevent leakage of hydraulic fluid from the pump chamber 50b.

Mounted within the pump chamber 50b is a cylindrical pump member 50d which includes a first passageway 50f which extends lengthwise of the cylindrical pump member 50d, and a somewhat L-shaped passageway 50g which extends radially at the middle of the pump member 50d and then parallel to the piston axis, with an opening adjacent the face of the piston 50c. The pump member 50d is snugly received in the cylindrical recess 52 and is secured against axial movement by the engagement with the body portion 50a which forces member 50d into the bottom of recess 52. The intake for the pump chamber 50b is a passageway 56, as best shown in FIG. 8, which extends from the reservoir portion 22b through the housing to the pump chamber 50b. To interconnect the pump chamber 50b with the hydraulic cylinder 24, there is provided a passageway 58 extending from the base of the recess 52 which is formed with a conical shape, to the right end of the recess 34 formed in the upper housing portion 22c as shown in FIG. 8. The intake to the pump chamber 50b is at the side intermediate the length of the pump chamber 50b, while the discharge 58 extends from the inner end of the recess 52 on the central axis of the piston 50c.

The L-shaped passageway 50g in the pump member 50d permits hydraulic fluid to flow from the portion of the pump chamber adjacent the conduit 56, into the space at the face of the piston 50c. There is a check valve 60 in the passageway 50g that permits the hydraulic fluid to flow from the reservoir to the face of the piston, but closes to prevent hydraulic fluid from flowing back toward the reservoir through the passageway 50g. On the other hand, the passageway 50f is formed with a check valve 62 which allows the hydraulic fluid to flow from the face of the piston 50c through the passageway 50f to the conduit 58, but on the return stroke of the piston 50c will not permit hydraulic fluid to flow through the passageway 50f toward the face of the piston 50c.

Figure 8A:
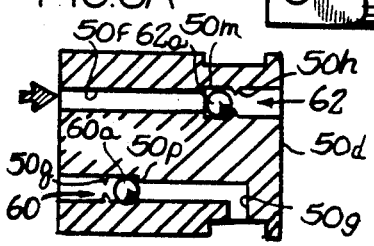
FIG. 8A is an enlarged view of the check valves of a pump member.

As best seen in FIG. 8A, the pump member 50d is formed very simply and inexpensively, and uses small spherical balls for the check valves 60 and 62. The ball 62a of the check valve 62 is positioned in a large diameter, right-hand end portion of the passageway 50f. The ball is seated in seat 50m by back pressure from hydraulic fluid in the hydraulic cylinder 24 and fluid conduit 58. A pair of metal tangs 50n are struck from the metal walls of the large-diameter passageway to block movement of the ball in its movement to the right as viewed in FIG. 8A when hydraulic fluid is pumped about the check valve ball 62a, now held by the two small tangs, leaving plenty of space for the hydraulic fluid to flow past the unseated check valve and into the passageway 68. In a similar manner, the check valve 60 includes a ball 60a in a large-diameter portion of the passageway 50g. The ball 60a seats at 50p which is the juncture between the large diameter and small-diameter portions of the passageway 50g. A pair of small, metal depending tangs 50q retain the ball in the passageway 50g.

Accordingly, each time the piston reciprocates it first draws hydraulic fluid through the fluid conduit 56, through the passageway 50g in the pump member 50d, into the space at the face of the piston 50c. While this inflow of hydraulic fluid is occurring, the check valve 62 is seated in the passageway 50f, preventing any flow toward the piston through the passageway 50f. As the piston 50c moves back toward the pump member 50d, the check valve 60 seats in the passageway 50g, preventing the flow of hydraulic fluid therethrough while the check valve 62 unseats, allowing the hydraulic fluid to pass through the passageway 50*f* into the fluid conduit 58 and thence to the hydraulic cylinder 24.

Figure 4:
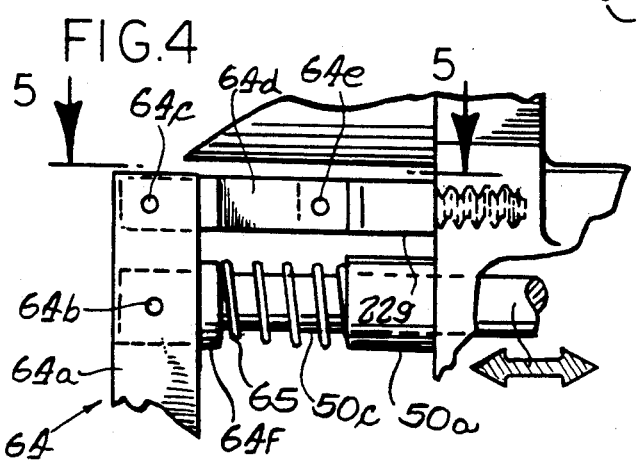
FIG. 4 is an enlarged fragmentary vertical sectional view of a portion of the dispensing apparatus of FIG. 1 including the manually operated lever for powering the apparatus.
Figure 5:
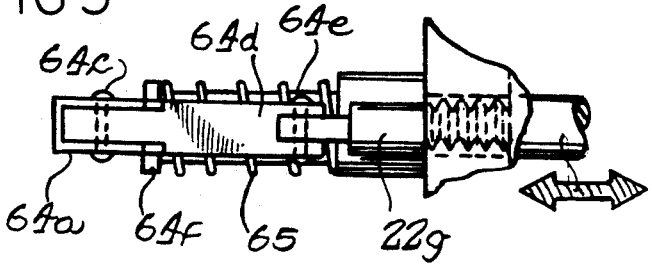
FIG. 5 is an enlarged fragmentary horizontal sectional view taken on line 5—5 of FIG. 4.

In order to operate the pump 50, there is provided a manually operated pump drive means 64 which includes an operating lever 64*a* pivotally connected by pin 64*b* to the outer end of the pump piston 50*c*. The upper end of the lever 64*a* is provided with a pivot pin 64*c* which interconnects the lever 64*a* with a link 64*d*. The inner end of the link 64*d* is connected by pin 64*e* to a housing post 22*g*. Thus, when the lever 64*a* is rotated manually counterclockwise as shown in FIG. 4, the piston 50*c* is displaced to the right, thereby forcing hydraulic fluid from the pump chamber 50*b* up into the hydraulic cylinder 24. The link 64*d* permits the outer end of the piston 50*c* to move in a pure rectilinear manner, while the upper end of the lever 64*a* at the pin 64*c* may move on the arc as the lever 64*a* rotates. The lever 64*a* cooperates with the reservoir portion 22*b* to provide a hand grip by which the user may manipulate and direct the apparatus 20 and, at the same time, by applying pressure and squeezing the lever 64*a* toward the reservoir or handle portion 22*b*, causes the pump 50 to drive the plungers 32 in a dispensing direction through the action of the hydraulic cylinder 24. Upon release of hand pressure on the lever 64*a*, a return spring 65 encircling the outer end of the piston 50*c* causes the piston 50*c* to move to the left as viewed in FIG. 4, drawing hydraulic fluid into the pump chamber 50*b*. The spring 65 bears on its right end against the body portion 50*a* of the pump 50 and on its left end against a bearing block 64*f* carried by the lever 64*a*. Thus, the pump 50 is operated by oscillating the lever 64*a* with hand pressure in the counterclockwise direction and spring pressure to return the lever 64*a* in the clockwise direction as viewed in FIGS. 3 and 4.

Once the plungers 32 have been driven to the limit of their possible movement within the cartridges 26, it is necessary to withdraw the plungers to discard the empty cartridges and replace them with filled cartridges. For the purpose of returning the plungers and the hydraulic cylinder to the load position, means are provided to move the hydraulic fluid from the high pressure side of the hydraulic cylinder. To this end there is provided a bypass passageway 66 which is somewhat L-shaped as see in FIG. 6. At the junction of the two legs of the L-shaped passageway 66, there is a manually operable valve means 68 which is threadedly received in an opening in the housing 22. The valve 68 includes an axially movable valve member 68*a* which may seat or unseat a ball valve 68*b*. When the plungers are to be returned to their load position, the valve 68 is rotated to the open position, unseating the ball valve 68*b* and permitting hydraulic fluid to pass directly from the hydraulic cylinder 24 to the reservoir portion 22*b*. To accomplish this discharge of the hydraulic fluid from the hydraulic cylinder 24, the yoke 48 is grasped by the user and drawn to the right as viewed in FIG. 2 until the plungers are in their fully withdrawn position. At this point all of the hydraulic fluid has been displaced from the volume to the right of the piston 24*b*, as shown in FIG. 7. The expended cartridges may then be removed from the apparatus 20 and replaced by fresh, filled cartridges.

Figure 6:
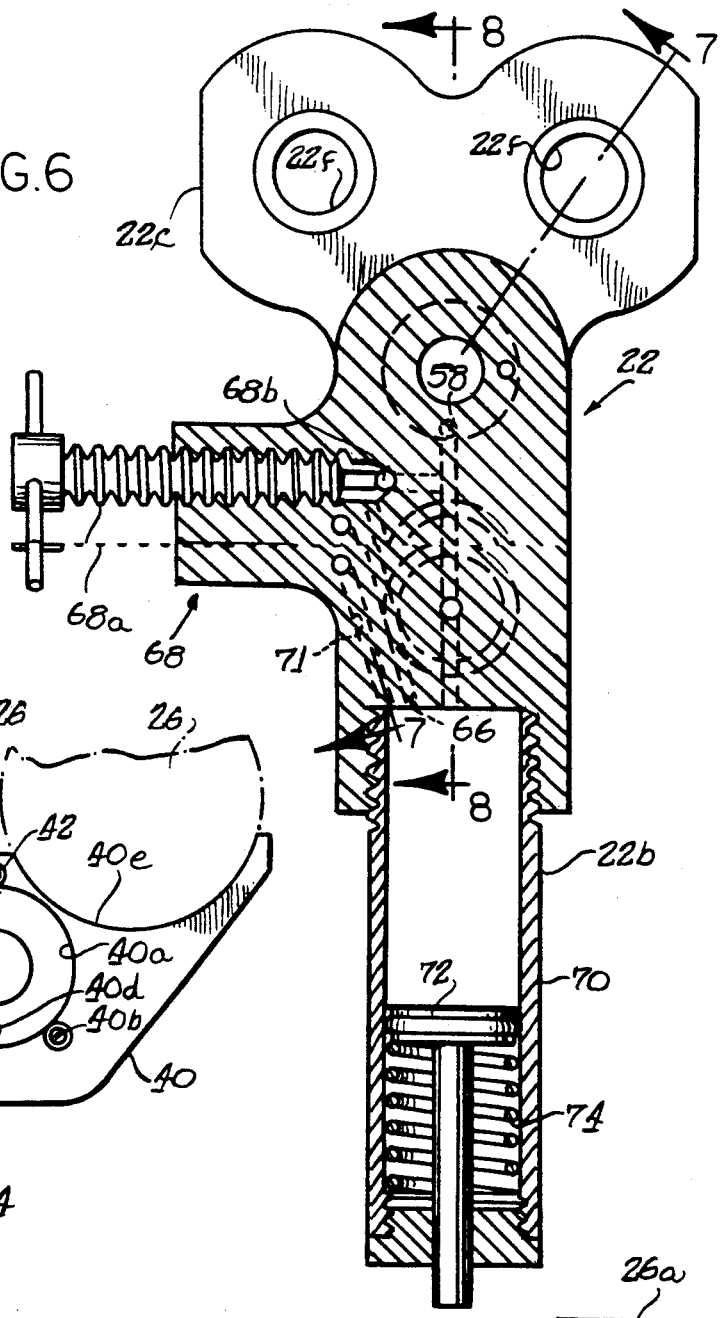
FIG. 6 is a fragmentary vertical sectional view taken substantially along line 6—6 of FIG. 1.

Referring to FIG. 6 of the drawings, the reservoir portion 22*b* of the housing 22 is shown in cross-section. Included therein is a reservoir 70 which includes a piston 72 and a biasing spring 74 to pressurize the hydraulic fluid contained in the reservoir 70. The fluid conduit 44 is described above as connecting one end of the hydraulic cylinder through the end plate 40 back to the housing 22 and the reservoir portion 22*b*. As viewed in FIG. 7, the hydraulic cylinder 24 has a right end to which the pump 50 supplies pressurized hydraulic fluid. The conduit 44 serves to supply hydraulic fluid to the left end of the hydraulic cylinder 24. Thus, as the fluid is pumped into the right end of the hydraulic cylinder by the pump 50, fluid is displaced from the left end of the hydraulic cylinder 24, passing through the conduit 44 and an L-shaped passageway 71 into the reservoir 70 and ultimately pumped back up into the right end of the hydraulic cylinder 24. By maintaining the hydraulic fluid on both sides of the piston 24*b*, any problems involved in displaced air and the like are avoided. In addition, the hydraulic cylinder 24 serves to store most of the excess fluid, with the reservoir 70 needing to store only the differential between the oil required to fill the hydraulic cylinder 24 with the piston in the left position and the amount required when the piston is in the righthand-most position, as viewed in FIG. 7. It may be readily appreciated that in the left position, less hydraulic fluid will be accommodated within the hydraulic cylinder 24 since the piston rod 24*c* also occupies a portion of the volume within the tubular housing 24*a*. Accordingly, the reservoir need only accommodate a volume of hydraulic fluid which is substantially equal to the cubic volume of that portion of piston rod 24*c* that is accommodated within the hydraulic cylinder. The piston 72 and the spring 74 apply the limited pressure necessary to maintain the hydraulic fluid within the low pressure end of the hydraulic cylinder 24.

To briefly review the operation of the apparatus 20, reference should be made to FIGS. 1–3. To place the apparatus in the condition for loading cartridges of adhesive materials, the manually operated valve 68 must be opened by rotating the valve member 68*a* to permit the hydraulic fluid in the cylinder 24 to by-pass the pump 50 and return to reservoir 70 through the L-shaped bypass passageway 66. The user then draws the yoke 48 to the right as shown in FIG. 3 until the plungers 32 and piston rod 24*c* have moved to the limit of their movement placing the disc members 32*a* of the plungers 32 against the upper housing portion 22*c*. The valve 68 is then closed and the cartridges are then loaded into the apparatus 20.

This loading is accomplished by raising the bail 46 upwardly and inserting the cartridges with the ends adjacent the displaceable walls 26*d* extending into the annular recesses 22*d* and resting the other ends of the cartridges in the curved recesses 40*e* on the end plate 40. The bail 46 is then dropped to the operating position shown in FIG. 1 where it engages and locks the cartridges 26 in position for dispensing.

The apparatus 20 may then be grasped in one hand which wraps around the reservoir portion 22*b* of the housing and the pump operating lever 64*a*. As thus held, the apparatus 20 may be manipulated to place the nozzle 30 in position to deposit a mixed quantity of adhesive components from the two cartridges onto the parts which are to be secured together. With the nozzle appropriately positioned, the pump operating lever 64*a* is repeatedly operated by closing the hand, forcing the lever toward the reservoir portion 22*b* of the housing. On each release of the hand pressure on the lever 64*a*, the spring 65 moves the pump piston 50*c* on the intake stroke at which time the piston 50*c* draws hydraulic fluid into the pump chamber 50*b* and into the space between the piston 50*c* and the pump body 50*d*.

As the hydraulic fluid is forced through passageway 58 into the hydraulic cylinder 24, the piston 24*b* is moved to the left as viewed in FIG. 7, causing the plungers 32 to be projected into the cartridges 26, forcing the walls 26*d* to the left and dispensing the adhesive materials through the nozzle 30. When the contents of the cartridges have been dispensed, the emptied tubes 26*a* are removed by lifting the bail 46 and retracting the plungers 32 in the manner described above.

From the foregoing description it may be readily appreciated that there has been provided a simple and easily operated apparatus for dispensing adhesive materials from cartridge-type containers. The illustrated apparatus is in the form of a conventional caulking gun with a horizontal holder or support means for the cartridge or cartridges and a depending handle and an operating lever 64*a* to be gripped and pulled toward the handle. This caulking gun is very portable because it has no long hoses as does a pneumatic gun connected by a hose to a powered air compressor. The preferred caulking gun illustrated herein is made of aluminum parts to be lightweight, although heavy impact and lightweight plastic could be used for some parts such as the handle reservoir. The illustrated caulking gun has no hoses, although it could have; hoses can be ruptured, can become caught on things in a construction site and can be costly if they are armored hoses to prevent damage thereto. An unskilled workman need only be taught how to allow the hydraulic fluid to return from the hydraulic cylinder to the handle reservoir Otherwise, the hydraulic gun operates in the simple manner of the mechanical gun by squeezing a lever toward a handle. The hydraulic pump and passageways are all internal in this preferred embodiment of the invention, to provide a clean and rugged design that won't be damaged with rough usage at a construction site. While one or more hydraulic cylinders could be positioned behind the cartridges to drive the plungers 32 this would increase the length of the gun. By having the cylinder 24 below the cartridge holder, the design is kept short in total length. The simple hydraulic pump 50 provides a manually operated means for easily dispensing the adhesive materials from both of the cartridges 26 simultaneously. The available purely mechanical tools or guns for dispensing such materials are difficult to operate and tend to be uneven in the rate at which materials may be dispensed from the nozzles thereon. The hydraulic pump 50 provided herein, along with the hydraulic cylinder 24, provides a substantial mechanical advantage, making it a simple task to operate the apparatus manually and achieve a very uniform and consistent rate of dispensing of the adhesive materials.

By positioning the hydraulic cylinder immediately adjacent and equidistant from both of the cartridges of adhesive material, the mechanical problems in delivering the axial forces to the plungers for each of the cartridges is reduced to a minimum. The bearings 22*f* provided in the housing 22 for the plunger drive rods 32 and the piston rod 24*c*, along with the yoke 48, reduces to a minimum the unwanted turning moments on the plunger rods.

The manual valve associated with the bypass passageway 66 provides an effective means for permitting the hydraulic mechanism to be returned to its load position with a minimum amount of effort. The valve 68 is simply opened and the yoke 48 is grasped and pulled out by the user, at which time the valve 68 is again shut and the apparatus is ready for the next use cycle.

Although the invention has been described with respect to a preferred embodiment, it is not to be so limited, as changes and modifications may be made therein which are within the scope of the invention as defined by the appended claims.

What is claimed is:

1. A portable hand-held adhesive dispensing gun which may be manipulated and powered while held by an operator comprising (a) a pair of elongated cylindrical disposable cartridges containing adhesive materials to be mixed together, said cartridges each having a discharge end and an operating end with a displaceable end wall to which force is applied to discharge simultaneously the contents of each cartridge for mixing together, (b) an elongated frame including a portion extending horizontally for receiving the disposable cartridges and for supporting the cartridges side-by-side, (c) a hydraulic cylinder means supported by said frame and having a power piston means within said cylinder with a piston rod means connected to said power piston means and extending from said cylinder, (d) a pair of elongated plungers mounted on said frame for axial slidable movement into said adhesive containing cartridges to discharge the contents thereof, said plungers being disposed parallel to said piston rod means, said plungers and piston rod means being coupled together to move in unison, (e) a manually operated hydraulic pump supported by said frame and connected to supply fluid from a reservoir to said hydraulic cylinder means to drive said power piston means and said plungers to discharge the contents of said cartridges, (f) a gun handle depending from the horizontal frame and including a handgrip portion and pump operating lever supported by said frame and extending laterally with respect to said hydraulic cylinder means, said pump operating lever being mounted adjacent said handgrip portion for limited movement toward and away from said handgrip portion to drive said pump to supply fluid to said hydraulic cylinder means.

2. A portable hand-held adhesive dispensing gun as recited in claim 1 wherein said pump operating lever is pivoted with respect to said handgrip portion, said lever and handgrip portion being closely spaced to permit an operator's hand to clasp both said lever and handgrip portion and squeeze them together to produce said limited movement to drive said pump to supply fluid to said hydraulic cylinder.

3. Apparatus in accordance with claim 1 in which the hydraulic cylinder means includes a housing positioned in close parallel relationship to the elongated horizontal frame portion for the cartridges, the gun handle being located at one end of the housing and frame portion.

4. Portable apparatus for dispensing adhesive materials comprising (a) a housing, (b) a fluid pump enclosed within said housing and including manual operating means for delivering fluid under pressure from a reservoir, (c) a hydraulic cylinder having a first end supported on said housing and a second end extending therefrom, said hydraulic cylinder including a piston displaceable axially of said cylinder and a piston rod coupled to said piston and extending from said first end of said cylinder, (d) means coupling said fluid pump to said hydraulic cylinder to supply fluid to one side of said piston upon manual operation of said pump to displace said piston and reciprocate said piston rod, (e) support means detachably supporting a plurality of elongated cylindrical cartridges containing adhesive materials, said cartridges each having a discharge end and an operating end with a displaceable end wall to which force is applied to discharge the contents of said cartridge, said support means including means on said housing for supporting said operating ends and means on said second end of said hydraulic cylinder for supporting said discharge ends of said cartridges, (f) a pair of drive rods mounted for reciprocating movement in said housing and being disposed in parallel spaced relation to said piston rod, (g) means drivingly coupling said piston rod to said drive rods so that displacement of said piston by pumped fluid causes said drive rods to displace said end walls and discharge adhesive materials from said cartridges.

5. Portable apparatus for dispensing adhesive materials as recited in claim 4 wherein said hydraulic cylinder is positioned equidistant between said adhesive cartridges and closely adjacent said adhesive cartridges, elongated bearing means in said housing supporting said drive rods and said piston rod for axial reciprocating movement, said means drivingly coupling said piston rod to said drive rods comprising a yoke secured to the ends of said drive rods remote from the end of said piston rod extending from said hydraulic cylinder.

6. Portable apparatus for dispensing adhesive materials as recited in claim 4 wherein said housing is provided with a laterally extending handle, said manual operating means including a pump lever pivotally mounted with respect to said housing and positioned adjacent said handle, said pump including a displaceable means for drawing fluid from said reservoir on movement in a first direction and for forcing fluid into said hydraulic cylinder on movement in a second direction, said displaceable means being connected to said pump lever so that pivotal movement of said pump lever delivers fluid from said reservoir to said hydraulic cylinder.

7. Portable apparatus for dispensing adhesive materials as recited in claim 6 wherein said displaceable means comprises a pump piston mounted for reciprocation in a pump chamber and a pump connecting link connecting said piston to said pump lever whereby pivotal movement of said pump lever reciprocates said pump piston.

8. Portable apparatus for dispensing adhesive materials as recited in claim 7 wherein said pump includes conduit means between said reservoir and said pump chamber and between said pump chamber and said hydraulic piston, check valves in said conduit means restricting fluid flow in the direction from said hydraulic cylinder to said reservoir.

9. Portable apparatus for dispensing adhesive materials as recited in claim 8 including a fluid return conduit extending from said hydraulic cylinder to said reservoir, manually operable valve means movable between a position obstructing flow through said return conduit during operation of said pump and a non-obstructing position for manual return of said drive rods and hydraulic cylinder piston rod to an initial position for loading and unloading said cartridges from said support means.

10. Portable apparatus for dispensing adhesive materials as recited in claim 4 wherein said means coupling said fluid pump to said hydraulic cylinder supplies said fluid to said first end of said hydraulic cylinder, a fluid conduit extending from said second end of said hydraulic cylinder to said reservoir to supply fluid to the side of said hydraulic cylinder piston away from the side exposed to the fluid supplied from said pump, and means pressurizing said reservoir to force fluid into said second end of said hydraulic cylinder.

11. Portable apparatus for dispensing adhesive materials as recited in claim 10 wherein said means pressurizing said reservoir comprises a spring biased wall which maintains a pressure on the fluid confined in said reservoir.

12. Portable apparatus for dispensing adhesive materials as recited in claim 11 wherein said reservoir comprises an elongated cylindrical member of constant internal diameter and having an upper end to which the fluid conduit to said hydraulic cylinder and to said fluid pump connects, said spring biased wall being a piston movable axially of said elongated cylindrical member and biased toward said upper end of said cylindrical reservoir by a helical compression spring.

13. Portable apparatus for dispensing adhesive materials as recited in claim 4 wherein said support means on said housing comprises a pair of shallow annular recesses formed in said housing to receive said operating ends of said cartridges, said support means on said second end of said hydraulic cylinder comprising a bracket formed with complementary recesses each of which receives one of said cartridge second ends and a U-shaped bail having spaced legs and a retaining plate, the free ends of said U-shaped bail being pivoted to said housing for movement between a cartridge loading position and an operative position in which the retaining plate of said U-shaped bail is engaged with said discharge ends of said cartridges to retain said cartridges in a loaded position.

14. Apparatus for dispensing adhesive materials from a pair of disposable cartridges of the type each having a cylindrical housing with a restricted discharge opening at one end and a movable wall at the other end comprising (a) a frame including support means for releasably supporting the pair of said disposable adhesive cartridges, (b) at least one hydraulic cylinder mounted on said frame and extending parallel to and coextensive with said cartridge when mounted in said support means, said hydraulic cylinder including a power piston mounted for axial movement within a cylindrical housing, a piston rod supporting said power piston on one end with a second end extending outwardly of said cylindrical housing, (c) a pair of plungers each including a drive head and a support rod, said support rods being mounted on said frame for axial movement, said plungers being aligned with said adhesive cartridges supported on said frame to provide engagement between said drive heads and said movable walls and to provide displacement of said walls to discharge simultaneously the contents of said cartridges through said discharge openings, means coupling said support rods to said piston rod to cause said drive heads and power piston to move together, (d) a hand operated pump including a fluid reservoir supported by said frame, said pump including a manually displaceable piston for delivering fluid from said reservoir to said hydraulic cylinder under pressure to displace said power piston and said plungers in a direction to discharge the contents of said cartridges simultaneously, (e) a fluid bypass communicating between said hydraulic cylinder and said reservoir to return fluid directly to said reservoir bypassing said pump, said fluid bypass including a manually operable valve movable between open and closed positions.

15. Apparatus for dispensing an adhesive material as recited in claim 14, said two adhesive cartridges being positioned in adjacent coextensive relationship with adjacent discharge openings, a mixing nozzle connected to said cartridges to receive and mix adhesive materials from said two cartridges and to dispense through a single opening the mixture of said adhesive materials.

16. Apparatus for dispensing adhesive material as recited in claim 14 wherein said pump includes a pump chamber and a pump piston mounted for reciprocation within said chamber for drawing fluid from said reservoir and delivering it under pressure to aid hydraulic cylinder, conduit means extending between said reservoir and said pump chamber and between said hydraulic cylinder and said pump chamber, check valves in said conduit means restricting fluid flow in the direction from said hydraulic cylinder to said reservoir.

17. Apparatus for dispensing adhesive materials as recited in claim 14 wherein said hand operated pump is operable to drive said plunger from a first position in which said adhesive cartridge may be loaded onto said support means to a second position in which said plunger extends into said adhesive cartridge after having displaced said movable wall over the length of said cartridge to discharge the contents thereof, said plunger being movable manually from said second position to said first position by opening said bypass valve and applying a manual force axially of said plunger rod.

18. Apparatus for dispensing an adhesive material from a cartridge of the type having a cylindrical housing with a restricted discharge opening at one end and a movable wall at the other end comprising (a) a frame including support means for one said adhesive cartridges, (b) a hydraulic cylinder mounted on said frame and extending parallel to and coextensive with said cartridge when mounted in said support means, said hydraulic cylinder including a power piston mounted for axial movement within a cylindrical housing, a piston rod supporting said power piston on one end with a second end extending outwardly of said cylindrical housing, (c) a plunger including a circular drive head and a support rod, said support rod being mounted on said frame for axial movement parallel to said piston rod, said plunger being aligned with said adhesive cartridge supported on said frame to provide engagement between said drive head and said movable wall and to provide displacement of said wall to discharge the contents of said cartridge through said discharge opening, means coupling said support rod to said piston rod to cause said drive heads and power piston to move together, (d) a hand operated pump including a fluid reservoir supported by said frame, said pump including a manually displaceable piston for delivering fluid from said reservoir to said hydraulic cylinder under pressure to displace said power piston and said plungers in a direction to discharge the contents of said cartridge, (e) a fluid bypass communicating between said hydraulic cylinder and said reservoir to return fluid directly to said reservoir bypassing said pump, said fluid bypass including a manually operable valve movable between open and closed positions, said pump including a pump chamber and a pump piston mounted for reciprocation within said chamber for drawing fluid from said reservoir and delivering it under pressure to said hydraulic cylinder, conduit means extending between said reservoir and said pump chamber and between said hydraulic cylinder and said pump chamber, check valves in said conduit means restricting fluid flow in the direction from said hydraulic cylinder to said reservoir, said conduit means extending between said hydraulic cylinder and said pump chamber connects to a first end of said hydraulic cylinder, and a fluid conduit connecting the other end of said hydraulic cylinder to said reservoir.

19. Apparatus for dispensing adhesive materials as recited in claim 18 including means for pressurizing said reservoir to force fluid from said reservoir into said other end of said hydraulic cylinder.

20. Apparatus for dispensing adhesive materials as recited in claim 19 wherein said reservoir comprises a tubular member secured to said frame at an upper end and closed at a lower end, said conduit means and said fluid conduit connect to the upper end of said reservoir, said pressurizing means comprising a reservoir piston mounted for axial movement within said tubular member and biased upwardly by a helical spring compressed between said reservoir piston and said closed lower end of said tubular member.

21. Apparatus for dispensing and mixing adhesive material from a pair of cartridge type containers each one having a cylindrical housing with a fixed end wall with a restricted discharge opening at one end and a displaceable circular wall at the other end movable toward the fixed end wall to discharge its contents, the combination comprising a frame for supporting said cartridges in parallel adjacent positions, a mixing nozzle supported on said frame and positioned to receive adhesive materials from said discharge opening in both of said cartridges and to mix said adhesive materials and discharge the adhesive mixture from said nozzle, a hydraulic cylinder mounted on said frame parallel to and coextensive with said cartridges, said hydraulic cylinder including a first piston displaceable therein and a piston rod secured to said first piston and coaxial with said hydraulic cylinder, drive rods mounted in said frame for axial movement parallel to said piston rod, said drive rods having first and second ends, said first end of each being coupled to one of said displaceable walls, a yoke coupling said piston rod and said second ends of said drive rods for coordinated movement to discharge said adhesive materials from said cartridges, a manually operated pump for pumping fluid from one end of said hydraulic cylinder to the other end to displace said first piston and piston rod to dispense adhesive materials from said cartridges, and selectively operable fluid bypass conduit means to bypass said pump and circulate fluid from said other end of said hydraulic cylinder to said one end of said hydraulic cylinder during manual displacement of said piston rod and said drive rods without use of said pump.

22. Apparatus for dispensing and mixing adhesive material as recited in claim 21 including a reservoir which is pressurized by a spring biased piston, first conduit means connecting said one end of said hydraulic cylinder to said reservoir, second conduit means connecting said reservoir to said other end through said pump, said selectively operable fluid bypass conduit means including third conduit means extending from said other end of said hydraulic cylinder to said reservoir and a manually operated valve to control fluid flow through said third conduit means.

23. Apparatus for dispensing and mixing adhesive material as recited in claim 21 including a handle usable by an operator to manipulate and power said apparatus while held in one hand by said operator, said handle including a handgrip portion and operating lever supported by said frame and extending laterally with respect to said hydraulic cylinder, said operating lever being mounted adjacent to said handgrip portion for limited movement toward and away from said handgrip portion to drive said hydraulic cylinder and said drive rods to discharge the contents of said cartridges.

* * * * *